United States Patent [19]

Ogata et al.

[11] 4,153,485

[45] May 8, 1979

[54] PROCESS FOR HEATING STEEL POWDER COMPACTS

[75] Inventors: Kazuo Ogata; Seiya Furuta, both of Kobe, Japan

[73] Assignee: Kobe Steel, Ltd., Kobe, Japan

[21] Appl. No.: 825,470

[22] Filed: Aug. 17, 1977

Related U.S. Application Data

[63] Continuation of Ser. No. 644,921, Dec. 29, 1975, abandoned.

[30] Foreign Application Priority Data

Dec. 28, 1974 [JP] Japan ..... 49/3942

[51] Int. Cl.[2] ..... C21D 1/00

[52] U.S. Cl. ..... 148/126; 75/211; 148/16; 148/20.3

[58] Field of Search ..... 148/16, 16.5, 16.6, 148/20.3, 126; 75/200, 203, 211, 224, 0.5 AA; 252/372, 374, 376

[56] References Cited

U.S. PATENT DOCUMENTS

| | | | |
|---|---|---|---|
| 2,342,799 | 2/1944 | Goetzel | 148/16 |
| 2,489,839 | 11/1949 | Whitney | 148/16.5 |
| 2,886,478 | 5/1959 | Beard | 148/16.5 |
| 2,914,434 | 11/1959 | Snavely | 148/16 |
| 2,992,147 | 7/1961 | Hayes | 148/16 |
| 3,109,735 | 11/1963 | Googin | 75/224 |
| 3,290,030 | 12/1966 | Goehring | 148/16 |
| 3,663,315 | 5/1972 | Hoffman et al. | 148/16.5 |
| 3,891,473 | 6/1975 | Latva | 148/16 |
| 3,893,852 | 7/1975 | Bergman et al. | 75/224 |

OTHER PUBLICATIONS

Lyman, et al., *Metals Handbook,* vol. 2, (Heat Treating), Metals Park (ASM), 1964, pp. 70, 71, 74 & 82.

*Primary Examiner*—L. Dewayne Rutledge
*Assistant Examiner*—John P. Sheehan
*Attorney, Agent, or Firm*—Oblon, Fisher, Spivak, McClelland & Maier

[57] ABSTRACT

A process is provided for heating steel powder compacts in a controlled atmosphere consisting of a primary gas containing at least 80% by volume of an inert gas, and a secondary gas comprising 0.1 to 5% by volume, based on the volume of said primary gas, of a paraffinic hydrocarbon. The process makes it possible to reduce the residual oxygen concentration in the steel powder compacts, while maintaining accurate control of the carbon content.

13 Claims, 1 Drawing Figure

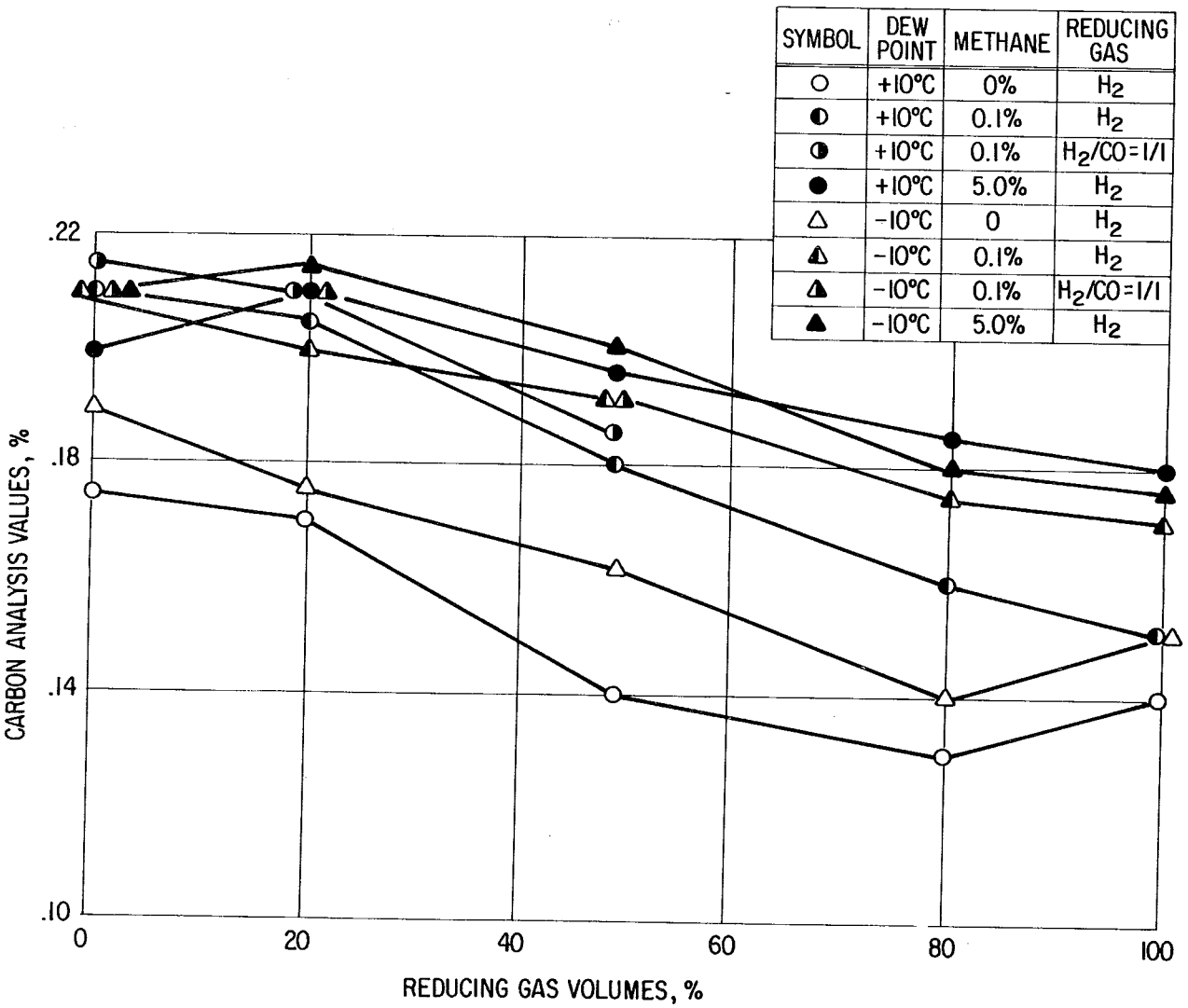
SYMBOL
DEW POINT
METHANE
REDUCING GAS
+10°C 0% H2
+10°C 0.1% H2
+10°C 0.1% H2/CO=1/1
+10°C 5.0% H2
-10°C 0 H2
-10°C 0.1% H2
-10°C 0.1% H2/CO=1/1
-10°C 5.0% H2
.22
.18
.14
.10
CARBON ANALYSIS VALUES, %
0
20
40
60
80
100
REDUCING GAS VOLUMES, %

PROCESS FOR HEATING STEEL POWDER COMPACTS

This is a continuation, of application Ser. No. 644,921 filed Dec. 29, 1975, now abandoned.

BACKGROUND OF THE INVENTION

1. Field of the Invention

The present invention relates to a method for reducing the oxygen content of steel compacts while simultaneously controlling the carbon content thereof. More particularly, it relates to a process for controlling the oxygen and carbon levels in steel compacts by heating the same in a reducing atmosphere.

2. Description of the Prior Art

It is well known that steel powder compacts obtained by compacting powder-metallurgical steel normally contain oxygen at levels as high as 1,000 to 2,000 ppm. Therefore, it is essential that in order to obtain products of good quality, the oxygen content should be reduced to acceptable levels in the subsequent heating step, while the carbon levels are controlled in the steel compacts. A variety of processes including the RX, SRX, and ASRX processes are known in which steel compacts such as those shown in Table 1 are treated under such gaseous atmospheres prepared from paraffinic hydrocarbons as methane, propane, butane and the like. An AX gas process has also been proposed which employs an atmosphere of a mixture of hydrogen and nitrogen gas obtained by the decomposition of ammonia.

In these processes, reducing atmospheres such as hydrogen gas are used to deoxidize the steel powder compacts. During the deoxidation reaction the reducing constituents in the atmosphere employed tend to react with oxygen in the powder compacts, thereby causing the evolution of oxidative gases. The oxidative gases then react with carbon in the powder compacts, and decarburized layers are formed. As a result, it is difficult to control carbon concentration in the steel compacts, and undesirable decarburized layers are formed in the steel compacts which result in poor quality of the products.

In the processing of the steel compacts, various reactions between the reducing gases in the atmosphere and the steel powder compacts occur which are illustrated as follows:

$$CO + FeO = FE + CO_2 \text{ (Deoxidation)} \quad (1)$$

$$CO_2 + Fe(C) = Fe + 2CO \text{ (Decarburization)} \quad (2)$$

$$H_2 + FeO = Fe + H_2O \text{ (Deoxidation)} \quad (3)$$

$$H_2O + Fe(C) = Fe + CO + H_2 \text{ (Decarburization)} \quad (4)$$

From the above reactions, it can be readily understood that decarburization reaction (4) is caused by the evolved water vapor. This reaction cannot be prevented even when an atmosphere of a low dew point (e.g., a dew point of −40° C.) is used. To overcome this problem, it has been proposed to use RX gases as an atmosphere and to heat the steel powder compacts to a high temperature for long periods of time. In this technique, however, oxygen remains at high levels in the steel powder compacts, although the carbon content is maintained roughly at an expected value. In the situation where high temperatures are used to reduce the oxygen content, it is extremely difficult to obtain a proper carbon level with the atmosphere because of inherent design features of the generator. Thus, accurate carbon control in the steel products is almost impossible.

As is obvious from the above equations, the atmosphere over the steel compact should be made strongly reductive, and reactions (1) and (3) should be allowed to proceed smoothly, in order to lower the oxygen content of the steel powder compacts. In practice, however, the decarburization reactions shown by equations (2) and (4) proceed concurrently. As a result of this contradictory behavior, neither the formation of decarburized layers can be prevented, nor can satisfactory deoxidation be achieved.

Thus, in accordance with the prior art processes, it is quite difficult to achieve sufficient deoxidation and to prevent the formation of decarburized layers while maintaining the carbon content of the steel compacts at an optimum level. In fact, it has been impossible to produce powder metallurgical steel products of excellent quality from steel powder compacts containing oxygen in excess of 1,000 ppm.

A need, therefore, exists for a method by which steel compacts can be heat treated to deoxidize the same while minimizing the decarburization of the same.

SUMMARY OF THE INVENTION

Accordingly, one object of the present invention is to provide a method for deoxidizing steel compacts while minimizing the decarburization of the same.

Another object of the present invention is to provide a reductive gas atmosphere under which the deoxidation of steel compacts can be conducted.

Briefly, these objects and other objects of the present invention as hereinafter will become more readily apparent can be obtained by a process for reducing the residual oxygen content thereof while controlling the carbon content thereof by heating the steel compacts under an atmosphere consisting of a primary gas and a secondary gas wherein the primary gas contains at least 80% by volume of an inert gas and the secondary gas comprises a paraffinic hydrocarbon in an amount of 0.1 to 5% by volume based on the volume of the primary gas.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawing, wherein:

The FIGURE is a graph which shows the relationship between the constituents of the atmosphere of the present invention versus the carbon analysis values of the steel products of the invention.

DETAILED DESCRIPTION OF THE PREFERRED EMBODIMENTS

In view of the drawbacks encountered in the conventional processes for heating steel powder compacts, intensive studies have been conducted in order to provide a heating process capable of fully deoxidizing steel powder compacts, while simultaneously controlling the carbon content thereof to a proper level. It has been found that the decarburization and deoxidation reactions illustrated in the previous equations can be controlled by using a mixed gas as an atmosphere, wherein the mixed gas is obtained by diluting the reducing gases in the same with an inert gas and by further adding thereto a paraffinic hydrocarbon gas.

According to the process of the present invention, the reducing atmosphere is rendered non-reactive with the materials to be heated, namely, the steel powder compacts, by diluting the reducing atmosphere with an inert gas. This dilution prevents the steel powder compacts from being decarburized by the atmosphere, and thus, the entire gamut of reactions described by equations (1) to (4) does not occur to the usual extent. On the other hand, deoxidation of the steel compacts occurs by the reaction of oxygen with the carbon which is premixed in the steel powder.

An essential feature of the present process is that the atmosphere contains a primary gas and a secondary gas. The primary gas contains at least 80% of an inert gas and the residual portion thereof is formed by other gases such as hydrogen and carbon monoxide. The secondary gas is a paraffinic hydrocarbon selected from the group of methane, ethane, propane, and butane. The secondary gas is admixed with the primary gas in an amount of 0.5 to 5% by volume, based on the volume of the primary gas. When steel powder compacts are heated in this atmosphere, the residual oxygen content in the compacts can be reduced, and control of the carbon content can be conveniently achieved.

Before presenting a detailed description of the heating process of the present invention, the conventional heat treatment process for steel compacts warrants further comment. As discussed above, various processes have been proposed to achieve deoxidation of steel powder compacts. Table 1 shows various examples of several conventional processes with corresponding detailed descriptions of the components of the atmospheres used.

Table 1

| Name of process | Fuel | $H_2$ | CO | $CO_2$ | $H_2O$ | $CH_4$ | $N_2$ |
|---|---|---|---|---|---|---|---|
| | $C_4H_{10}$ | 31.5 | 24.2 | 0.1 | 0.4 | 0.4 | 43.4 |
| RX | $C_3H_8$ | 32.9 | 23.7 | 0.1 | 0.4 | 0.4 | 42.5 |
| | $CH_4$ | 41.9 | 20.5 | 0.1 | 0.4 | 0.4 | 36.7 |
| | $C_4H_{10}$ | 66.4 | 20.4 | 6.3 | 6.5 | 0.4 | — |
| SRX | $C_3H_8$ | 67.4 | 19.2 | 6.7 | 6.5 | 0.4 | — |
| | $CH_4$ | 71.1 | 16.8 | 5.2 | 6.5 | 0.4 | — |
| | $C_4H_{10}$ | 61.3 | 21.9 | 4.6 | 6.5 | 0.4 | 5.3 |
| ASRX | $C_3H_8$ | 62.6 | 21.7 | 4.3 | 6.5 | 0.4 | 4.8 |
| | $CH_4$ | 65.4 | 18.7 | 3.3 | 6.5 | 0.4 | 5.7 |
| AX | $NH_3$ | 75.0 | 0 | 0 | 0.0 | 0.0 | 25.0 |

When one of the above conventional treatments is employed in a heat treatment process, deoxidation reactions (1) and (3) take place between the reductive constituents in the atmosphere, i.e., CO gas and hydrogen, and the metal oxide in the steel powder. Furthermore, deoxidation of the steel compact occurs by the reaction of oxygen with carbon in the steel powder compact, as shown by the following equation:

$$Fe(C)+FeO=2Fe+CO \quad (5)$$

On the other hand, decarburized layers are formed when oxidative gases such as $CO_2$ and $H_2O$ evolved from deoxidation reactions (2) and (4), as well as $O_2$ in the heating furnace, react with carbon in the steel powder.

The formation of decarburized layers can be prevented by suppressing reactions (2) and (4). However, the suppression of the decarburization reaction adversely affects the deoxidation reactions (1) and (3). Thus, in order to eliminate this adverse effect, it is advantageous to admix a paraffinic hydrocarbon gas, for example, methane, with the atmosphere in which the steel powder compacts are heated. The addition of methane to the atmosphere causes the following reactions (6), (7) and (8) to take place, so that the oxidative gas concentration can be reduced, resulting in decreased reactions of oxidative gases with carbon.

$$CO_2+CH_4=2CO+2H_2 \quad (6)$$

$$H_2O+CH_4=CO+3H_2 \quad (7)$$

$$O_2+2CH_4=2CO+4H_2 \quad (8)$$

In a first attempt, 2% methane was added to the atmosphere used in the RX ($CH_4$) process. When steel powder compacts were heated in this methane-rich atmosphere, the formation of decarburized layers could be prevented, but the residual oxygen concentration in the steel powder could not be reduced to an acceptable level, as shown by the data in Table 3. The reason for such a high oxygen concentration is that the reaction given by equation (5) has been inhibited because of the high CO potential in the atmosphere. This finding led to the discovery of the present invention that the addition of an inert gas to the reducing atmosphere lowers the CO potential. This dilution of the reductive atmosphere facilitates the deoxidation reaction (5), and also inhibits the decarburation reactions (2) and (4).

Thus, according to the process of this invention, not only can deoxidation be satisfactorily attained, but also the reactions between oxidative constituents in the atmosphere and carbon in the steel powder can be inhibited allowing only the reaction between oxygen in the steel powder, shown by equation (5), to proceed. Therefore, if the oxygen content of the steel powder compacts has previously been determined, and carbon has been added in a corresponding amount, then the carbon content of sintered products can be accurately controlled. This is shown by the following equation (9) which is derived from equation (5), $$y_c+X_c-\tfrac{3}{4}\cdot(x_o-y_o) \quad (9)$$

wherein $y_c$ and $y_o$ are the concentrations of carbon and oxygen, respectively, of the product; and $x_c$ and $x_o$ are the same concentrations of the elements in steel powder compacts before the sintering treatment, all of which are expressed by weight.

Carbon may be previously added as a composition into steel powder in larger amounts, or it may be mixed with steel powder in the subsequent step.

Having generally described the invention, a further understanding can be obtained by reference to a certain specific example which is provided herein for purposes of illustration only and is not intended to be limiting unless otherwise specified.

The steel powder compact employed in this example was prepared by admixing 0.32% graphite with an atomized alloy steel powder having a composition of 2Ni-0.5Mo-Bal Fe and compacting the powder to a density of 6.4 g/cc. The powder compact was charged into a continuous conveying type heating apparatus consisting of a rotary heating furnace and a meshbelt soaking pit. The heat treatment was conducted by introducing an atmosphere containing, as the primary gas, nitrogen, hydrogen, and carbon monoxide in varying ratios, and as the secondary gas, 0–10.0% by volume of methane. The methane was mixed with nitrogen before it was introduced into the furnace. If methane alone is to be added, a gas mixer is conveniently fitted to the charging pipe so that methane may be diluted homogeneously with the primary gas. The mixture of the major gas and the hydrocarbon gas was introduced at a flow rate of 20 $m^3$ per hour. During the heat treatment, this flow rate and the composition of the atmosphere were monitored by a flow meter and gas chromatography, respectively, and, if necessary, the flow rate and the composition were corrected.

The heating temperature and the soaking pit outlet temperature were controlled to maximum temperatures of 1,200° C. and 950° C., respectively. The compact was retained in the furnace for 17 minutes. After the heat treatment, the sintered preform was removed from the furnace and was directly forged to obtain a product. The product had a density greater than 99.8%.

This product was analyzed for its carbon and oxygen contents, and was checked for the presence of decarburized layers by means of microscopic observation. A single point in the FIGURE illustrates the relationship between the carbon analysis value for products and the amount of reducing hydrogen gas in the introduced primary gas. It is apparent from the FIGURE that the formation of decarburized layers is considerable in cases particularly where the atmosphere does not contain a paraffinic hydrocarbon gas, e.g., methane (these cases are denoted by symbols O and Δ in the FIGURE). The higher the ratio of reducing gases in the atmosphere, the greater the extent of decarburization. In other words, it is preferable that the primary gas contains at least 80% by volume of nitrogen as an inert gas.

Table 2

| Dew Point (°C.) | $CH_4$ (VOL. %) | $H_2$ (VOL. %) 0 | 20 | 50 | 80 | 100 |
|---|---|---|---|---|---|---|
| | 0 | X | X | X | X | X |
| | 0.1 | 0 | 0 | X | X | X |
| | 1.0 | 0 | 0 | X | X | X |
| + 10 | | | | | | |
| | 5.0 | 0 | 0 | X | X | X |
| | 8.0 | Δ | Δ | X | X | X |
| | 10.0 | Δ | Δ | X | X | X |
| | 0 | X | X | X | X | X |
| | 0.1 | 0 | 0 | X | X | X |
| | 1.0 | 0 | 0 | X | X | X |
| − 10 | | | | | | |
| | 5.0 | 0 | 0 | X | X | X |
| | 8.0 | Δ | Δ | X | X | X |
| | 10.0 | Δ | Δ | X | X | X |

Table 2 provides the data obtained from the present example. The dew points in the table show the extent to which the furnace was shielded against the outer atmosphere. That is, the higher the dew point, the less the extent of shielding. In Table 2, the symbol "X" indicates the case where decarburized layers of at least 0.5 mm in thickness were produced. The symbol "O" represents the case where no decarburized layer is produced. The symbol "Δ" represents the case where no decarburized layer is produced and carburized layers are produced. The symbol "Δ*" indicates the case where carburized layers are produced, and soot is deposited on the steel surfaces. As seen from Table 2, the primary gas preferably consists of at least 80% by volume of nitrogen as the inert gas, to prevent the formation of a decarburized layer during heating step. Table 2 also indicates that excellent results can be obtained by adding a secondary gas consisting of a paraffinic hydrocarbon gas, e.g., methane, to the primary gas in amounts of 0.1 to 5% by volume, based on the volume of the primary gas, in order to heat the steel compacts without promoting the formation of any decarburized or carburized layer. It has been found from further studies that products of good quality can be obtained when methane is mixed with the primary gas preferably in an amount of 2% by volume.

Table 3

| Atmosphere | Carbon content (%) | Oxygen content (ppm) |
|---|---|---|
| Atmosphere according to this invention | 0.21 | 70 |
| RX | 0.20 | 300 |
| RX + 2% $CH_4$ | 0.23 | 400 |

In Table 3, the residual oxygen concentrations in the sintered preforms are compared among 3 cases in which the atmosphere employed in the above example, the prior art RX gas, and the RX gas plus 2 vol. % methane were used. The atmosphere of this example consisted of the primary gas containing 95% nitrogen and 5% hydrogen, by volume, and the secondary gas of methane admixed with the primary gas at 2 vol. %, based on the volume of the primary gas. It is apparent from Table 3 that according to the process of the present invention, the residual oxygen concentration in the products can be reduced to as low a level as usually obtained in steel materials, and at the same time, the carbon content can be properly controlled.

Table 4

| CO (vol. %) | Oxygen content (ppm) |
|---|---|
| 0 | 50 |
| 5 | 50 |
| 12 | 100 |
| 20 | 400 |

Table 4 shows the residual oxygen concentrations in sintered preforms obtained by using the atmosphere of this example, wherein the methane gas was maintained at a constant level of 2% volume, based on the volume of the primary gas, and the reducing carbon monoxide gas in the primary gas was used at different levels of 0, 5, 12, and 20% by volume, with the remaining portion containing nitrogen gas. As indicated, the content of the residual oxygen gas increases with an increase in the amount of carbon monoxide contained in the primary gas. In order to reduce the oxygen content of the steel powder compacts to a level approximate to that of the usual steel materials, it is preferred that the carbon monoxide content be maintained at a level less than 12% by volume.

The influence of the carbon monoxide gas on the decarburization reaction is clearly shown by the single FIGURE in the drawing in which the carbon analysis values are plotted in terms of the reducing gas volumes. The results shown in this single FIGURE are obtained by a series of tests in which atmospheres are used each containing a reducing gas at the different levels of 0, 20 and 50% by volume as the primary gas in which carbon monoxide gas and hydrogen gas are mixed with each other at equal volumes to provide the reducing gas and in which the remaining gas includes nitrogen gas, and containing a secondary gas including methane gas at a level of 0.1% by volume with respect to the primary gas. As shown, the carbon analysis values of the sintered preforms are substantially similar to those of the preforms treated under the condition in which only hydrogen is used as the reducing gas. Therefore, it is possible to conclude that the influence of carbon monoxide on the decarburization reaction is as much as that of hydrogen.

While the present invention has been described with reference to a particular example in which only methane is used as the paraffinic hydrocarbon in the secondary gas, it should be noted that since paraffinic hydrocarbons are saturated-chain hydrocarbons having a general formula of $C_nH_{2n+2}$ and since they have very similar chemical properties, the paraffinic hydrocarbon used in this invention is not limited to methane. Since gaseous substances in the paraffinic series will provide similar effects, it is possible to use, as the secondary gas, ethane (n=2), propane (n=3), and butane (n=4), all of which are commercially available.

The reactions of hydrocarbons of the formula $C_nH_{2n+2}$ with oxidative gases can be represented by the following equations:

$$nCO_2+C_nH_{2n+2}=2nCO+(n+1)H_2 \quad (10)$$

$$nH_2O+C_nH_{2n+2}=nCO+(2n+1)H_2 \quad (11)$$

$$nO_2+2C_nH_{2n+2}=2nCO+(2n+2)H_2 \quad (12)$$

It is to be understood that the reducing power of hydrocarbons increases in proportion to the carbon atom number (n) in the molecule. When n=1, the above equations (10), (11) and (12) correspond to equations (6), (7) and (8) where methane is used. Therefore, in accordance with the procedure of this example, when methane is substituted by ethane (n=2), propane (n=3) and butane (n=4), the same reducing power as that of methane is obtained in an amount of 1/n as much as the methane volume. Since the amount of methane admixed with the primary gas is peferably 2% by volume, the preferred amounts for ethane, propane and butane are 1, 0.66, and 0.5% by volume, respectively.

It can now be appreciated from the foregoing description that the process for heating steel powder compacts according to the present invention makes it possible to decrease the residual oxygen concentration of the powder compacts to a level as low as that usually found in conventionally processed steel materials. The process of this invention also prevents both decarburized and carburized layers from being formed in steel, and controls the carbon content of the products to a proper level, whereby powder-metallurgical products of excellent quality can be obtained.

Having now fully described the invention, it will be apparent to one of ordinary skill in the art that many changes and modifications can be made thereto without departing from the spirit or scope of the invention as set forth herein.

What is claimed as new and intended to be secured by Letters Patent is:

1. A process for deoxidizing steel powder compacts which comprises: admixing and compacting with steel powder a quantity of carbon $x_c$; wherein $x_c$ is the carbon concentration in said steel powder compact prior to deoxidation and is $$x_c=\tfrac{3}{4}(x_o-y_o)+y_c,$$

wherein $x_o$ is the oxygen concentration of said steel compact prior to deoxidation;

$y_o$ is the oxygen concentration of said steel compact after deoxidation; and $y_c$ is the carbon concentration of said steel compact after oxidation wherein all concentrations are by weight;

heating said steel powder compact in the presence of an atmosphere which comprises a primary gas consisting essentially of hydrogen, carbon monoxide and at least 80 volume percent of an inert gas and 0.1 to 5 volume percent based on the volume of said primary gas of a secondary gas consisting essentially of a paraffinic hydrocarbon; and recovering a deoxidized steel powder compact free of carburized or decarburized layers.

2. The process of claim 1, wherein said primary gas contains a reducing gas.

3. The process of claim 2, wherein said gas comprises hydrogen at a level less than 20% by volume of said primary gas.

4. The process of claim 2, wherein said reducing gas comprises carbon monoxide at a level less than 12% by volume of said primary gas.

5. The process of claim 1, wherein said inert gas contains nitrogen gas.

6. The process of claim 1, wherein said paraffinic hydrocarbon is methane.

7. The process of claim 1, wherein said paraffinic hydrocarbon is ethane.

8. The process of claim 1, wherein said paraffinic hydrocarbon is propane.

9. The process of claim 1, wherein said paraffinic hydrocarbon is butane.

10. The process of claim 6, wherein said methane is admixed with said primary gas in an amount of 2% by volume based on the volume of said primary gas.

11. The process of claim 7, wherein said ethane is admixed with said primary gas in an amount of 1% by volume based on the volume of said primary gas.

12. The process of claim 8, wherein said propane is admixed with said primary gas in an amount of 0.66% by volume based on the volume of said primary gas.

13. The process of claim 9, wherein said butane is admixed with said primary gas in an amount of 0.5% by volume based on the volume of said primary gas.

* * * * *

UNITED STATES PATENT AND TRADEMARK OFFICE

CERTIFICATE OF CORRECTION

PATENT NO. : 4,153,485

DATED : May 8, 1979

INVENTOR(S) : Kazuo Ogata Et al

It is certified that error appears in the above-identified patent and that said Letters Patent are hereby corrected as shown below:

Claim 1, line 12, delete "oxidation" and insert --deoxidation--.

Signed and Sealed this

*Thirty-first* Day of *August 1982*

[SEAL]

*Attest:*

GERALD J. MOSSINGHOFF

*Attesting Officer*

*Commissioner of Patents and Trademarks*